US006516789B1

(12) United States Patent
Jones

(10) Patent No.: US 6,516,789 B1
(45) **Date of Patent: *Feb. 11, 2003**

(54) CENTRIFUGAL SUPERCHARGER HAVING LUBRICATING SLINGER

(75) Inventor: Daniel W. Jones, Lenexa, KS (US)

(73) Assignee: Accessible Technologies, Inc., Lenexa, KS (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/064,640

(22) Filed: Aug. 1, 2002

Related U.S. Application Data

(63) Continuation of application No. 10/064,418, filed on Jul. 11, 2002, now abandoned, which is a continuation of application No. 09/668,223, filed on Sep. 22, 2000, now Pat. No. 6,439,208.

(51) Int. Cl.[7] ..... F02B 33/00

(52) U.S. Cl. ..... 123/559.1; 415/198.1; 184/11.2; 184/11.1; 74/467

(58) Field of Search ..... 123/559.1; 415/199.1, 415/198.1, 124.2, 122.1; 184/11.2, 11.1; 74/467

(56) References Cited

U.S. PATENT DOCUMENTS

| | | | | | |
|---|---|---|---|---|---|
| 2,645,305 | A | * | 7/1953 | Ross | 184/11.1 |
| 3,065,822 | A | * | 11/1962 | McFee et al. | 184/11.1 |
| 3,508,630 | A | * | 4/1970 | Keller et al. | 184/11.1 |
| 4,090,588 | A | * | 5/1978 | Willover | 184/11.2 |
| 4,495,830 | A | * | 1/1985 | Yasue et al. | 74/467 |
| 4,502,837 | A | * | 3/1985 | Blair et al. | 415/198.1 |
| 4,653,976 | A | * | 3/1987 | Blair et al. | 415/198.1 |
| 6,129,510 | A | * | 10/2000 | Martin | 123/559.1 |
| 6,192,871 | B1 | * | 2/2001 | Middlebrook | 123/559.1 |
| 6,293,263 | B1 | * | 9/2001 | Middlebrook | 123/559.1 |
| 6,318,346 | B1 | * | 11/2001 | Martin | 123/559.1 |
| 2002/0096156 | A1 | * | 7/2002 | Palazzolo et al. | 123/559.1 |

* cited by examiner

*Primary Examiner*—Thomas Denion
*Assistant Examiner*—Thai-Ba Trieu
(74) *Attorney, Agent, or Firm*—Hovey Williams LLP

(57) ABSTRACT

A centrifugal supercharger includes a case presenting a compressor chamber and a transmission chamber. An impeller in the compressor chamber is mounted to a shaft that extends into the transmission chamber. The impeller shaft is drivingly connected to a power input shaft by intermeshing gears provided on the shafts. A portion of the transmission chamber defines a fluid reservoir in which lubrication fluid is held. The intermeshing gears, as well as the bearing assemblies supporting the shafts, are located outside the fluid reservoir portion of the transmission chamber. A rotatable fluid-propelling element partly submerged in the lubrication fluid contained within the reservoir portion ensures that sufficient but not excessive lubrication fluid is supplied to the intermeshing gears and the bearing assemblies. It is particularly believed that rotation of the partly submerged fluid propelling element causes lubrication fluid to be propelled to the intermeshing gears and lubrication fluid displaced from the gears is directed to the bearing assemblies. The supercharger may alternatively include an intermediate shaft and gears drivingly connecting the impeller shaft to the input shaft, wherein the low speed gear fixed to the input shaft is partly submerged in the lubricant reservoir and serves as the lubricant slinging element.

144 Claims, 5 Drawing Sheets

CENTRIFUGAL SUPERCHARGER HAVING LUBRICATING SLINGER

CROSS REFERENCE TO RELATED APPLICATIONS

This application is a continuation application of Application Ser. No. 10/064,418, filed Jul. 11, 2002 now abandoned, which is a continuation application of application Ser. No. 09/668,223, filed Sep. 22, 2000 now U.S. Pat. No. 6,439, 208, both of which are hereby incorporated by reference herein.

BACKGROUND OF INVENTION

1. Field of the Invention

The present invention relates generally to centrifugal superchargers for providing increased airflow to an engine. More particularly, the present invention concerns an improved transmission lubrication arrangement for effectively lubricating the transmission components that drivingly connect the impeller to the power source, without having to tap into the lubrication system for the engine and without limiting the transmission speed.

2. Discussion of Prior Art

Centrifugal superchargers are traditionally provided with an internal step-up transmission that serves to rotate the impeller significantly faster than the input shaft connected to the engine. It is particularly known to provide a centrifugal supercharger with an internal belt drive supported by prelubricated (e.g., grease-packed) bearing assemblies. Although this type of transmission eliminates the need for lubrication (except for that already provided with respect to the bearing assemblies), it is believed to have relatively low operational limitations that effectively prohibit the supercharger from generating large amounts of pressure increase and airflow. On the other hand, a number of conventional centrifugal superchargers, particularly the higher boost models, utilize a gear drive that must, along with the bearing assemblies supporting the gear drive, be continuously lubricated during operation. Those ordinarily skilled in the art will appreciate that gear-type transmissions generally have greater structural integrity and are able to transfer significantly more load than a belt-type transmission. However, a gear-type transmission typically requires dispersion of lubrication fluid generally throughout the transmission chamber.

In the past, such a lubrication requirement has been problematic. First, lubrication fluid is commonly supplied to the transmission chamber of the supercharger from the engine. This almost always requires a fluid line to be tapped into the oil reservoir of the engine, which is often considered highly undesirable. It might be possible to alternatively provide a separate lubrication reservoir dedicated solely to the supercharger, although such a circulating arrangement would obviously be costly and consume a considerable amount of valuable engine compartment space. With respect to either alternative, the manner in which lubrication fluid is typically directed to the transmission components (e.g, jets, wicking arrangements, etc.) is believed to be unreliable, ineffective and/or in other ways problematic.

There are also "self-contained" friction ball driven (e.g., Bendix drive) superchargers. That is to say, a number of superchargers wholly contain the lubrication fluid therein. Those ordinarily skilled in the art will appreciate that the transmission chamber of such a supercharger is typically filled with lubrication fluid. It has been determined, however, that a fluid-filled transmission chamber actually reduces the load capacity of the supercharger, as a result of the significant hydraulic separation forces caused by flooding the transmission and bearing assemblies. Furthermore, this type of construction adds heat and fails to provide sufficient cooling of the transmission.

SUMMARY OF INVENTION

Responsive to these and other problems, an important object of the present invention is to provide a supercharger that is capable of providing relatively high amounts of airflow (e.g., 1800 gasoline horsepower). It is also an important object of the present invention to provide a supercharger that is self-contained, such that the lubrication system for the transmission is confined to the supercharger itself. In addition, an important object of the present invention is to provide a transmission lubrication configuration that has virtually no limiting effect on the boost provided by the supercharger. Another important object of the present invention is to provide a supercharger having a gear-type transmission and an associated lubrication system that assuredly provides sufficient and effective lubrication to the transmission components. Yet another important object of the present invention is to provide a supercharger having a durable, simple and inexpensive construction.

In accordance with these and other objects evident from the following description of the preferred embodiments, the present invention concerns a supercharger having a case that defines a compressor chamber and a transmission chamber. The rotatable impeller in the compressor chamber is drivingly connected to a power source (e.g., an engine) by the transmission. The transmission chamber includes a fluid reservoir portion in which lubrication fluid is located, and at least part of the transmission is located within the transmission chamber but outside the reservoir portion. A fluid-propelling element serves to propel lubrication fluid from the reservoir portion of the transmission chamber to the part of the transmission. This configuration consequently permits the supercharger to be entirely self-contained, with the lubrication fluid being located entirely within the transmission chamber. Furthermore, the part of the transmission outside the reservoir portion is not subjected to significant hydraulic separating forces, which would otherwise be produced if it was submerged. Moreover, the fluid-propelling element is preferably arranged to create a fluid mist within the transmission chamber. It is believed that such an environment ensures effective and reliable lubrication of the transmission components.

The present invention also contemplates utilizing a rotatable component of the transmission as the fluid propelling element. The component projects into the reservoir portion of the transmission chamber and slings lubricant to the part of the transmission located in the transmission chamber but outside the reservoir portion thereof. In the preferred embodiment, the rotatable component comprises the relatively low speed drive gear provided on the input shaft of the supercharger.

Other aspects and advantages of the present invention will be apparent from the following detailed description of the preferred embodiment and the accompanying drawing figures.

BRIEF DESCRIPTION OF DRAWINGS

Several embodiments of the invention are described in detail below with reference to the attached drawing figures, wherein.

DETAILED DESCRIPTION

Figures 1, 2:
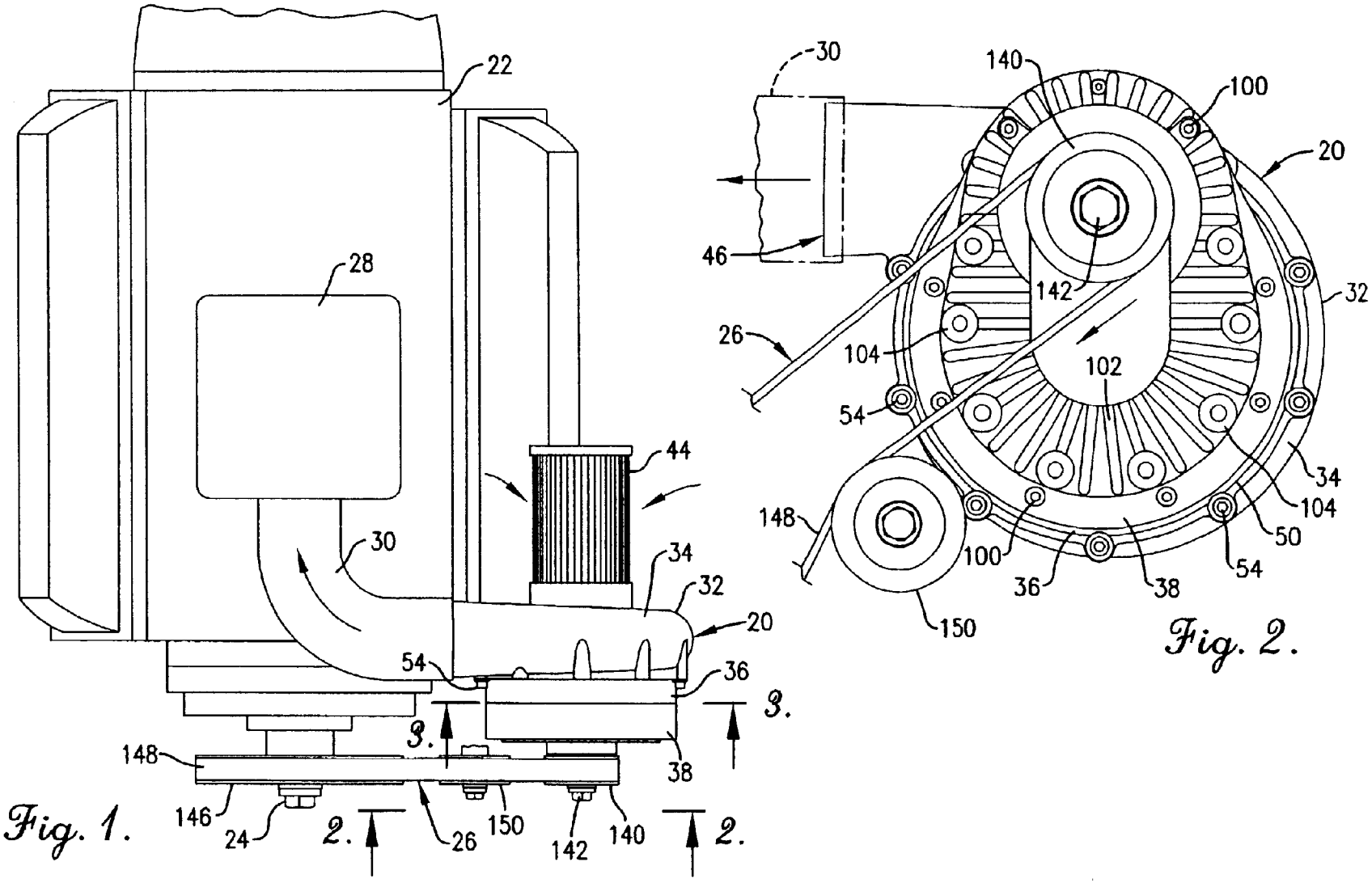
FIG. 1 is a fragmentary, partially schematic plan view of an internal combustion engine including a centrifugal supercharger constructed in accordance with the principles of the present invention.
FIG. 2 is an enlarged, fragmentary front elevational view of the engine taken along. line 2—2 of FIG. 1.

Turning initially to FIG. 1, the supercharger 20 selected for illustration is shown in use with an internal combustion engine 22 of a vehicle such as a boat or automobile. Although the illustrated engine 22 has eight cylinders, the principles of the present invention are equally applicable to various other types of engines. It is noted, however, that the supercharger 20 is preferably driven directly by the engine 22, with the crankshaft 24 and a belt drive 26 providing driving power to the supercharger 20. Moreover, the supercharger 20 is connected to the engine intake 28 (e.g., an intake plenum box) by a conduit 30, such that pressurized air generated by the supercharger 20 is directed to the intake 28. Again, the principles of the present invention are not limited to the illustrated application, but rather the inventive supercharger 20 may be associated with any system in which a highly pressurized air stream is desired. For example, it is entirely within the ambit of the present invention to utilize the supercharger 20 in various other types of reciprocating engines.

The illustrated supercharger 20 includes a case 32 that defines compressor and transmission chambers as identified hereinbelow. As perhaps best shown in FIG. 4, the preferred case 32 generally includes three main sections 34,36,38 that are formed of any suitable material (e.g., polished cast steel) and interconnected as will be described.

The case sections 34 and 36 cooperate to define a compressor chamber 40 in which incoming fluid (e.g., air, air/fuel mixture, etc.) is pressurized and accelerated. The case section 34 presents a central inlet opening 42 (see FIG. 4) through which fluid enters the chamber 40. A filter 44 (see FIG. 1) is preferably provided at the inlet opening 42, as shown, or somewhere upstream from the opening 42. Although not illustrated, the inlet opening 42 may alternatively communicate with a forwardly open conduit (not shown) that extends toward the front of the powered vehicle, such that air flow to the supercharger 20 is facilitated when the vehicle is moving in a forward direction. The case section 34 is configured in such a manner that a portion 40*a* of the compressor chamber 40 extends circumferentially around the inlet opening 42 to form a volute of progressively increasing diameter. The volute portion 40*a* of the compressor chamber 40 terminates at a tangential outlet opening 46 (see FIGS. 2 and 3), with the latter communicating with the engine intake 28 via conduit 30 (see also FIG. 1). In this regard, fluid entering the illustrated compressor chamber 40 flows axially through the inlet opening 42, is propelled generally radially into the volute portion 40*a,* and then directed along a generally circular path to the outlet opening 46.

Figure 4:
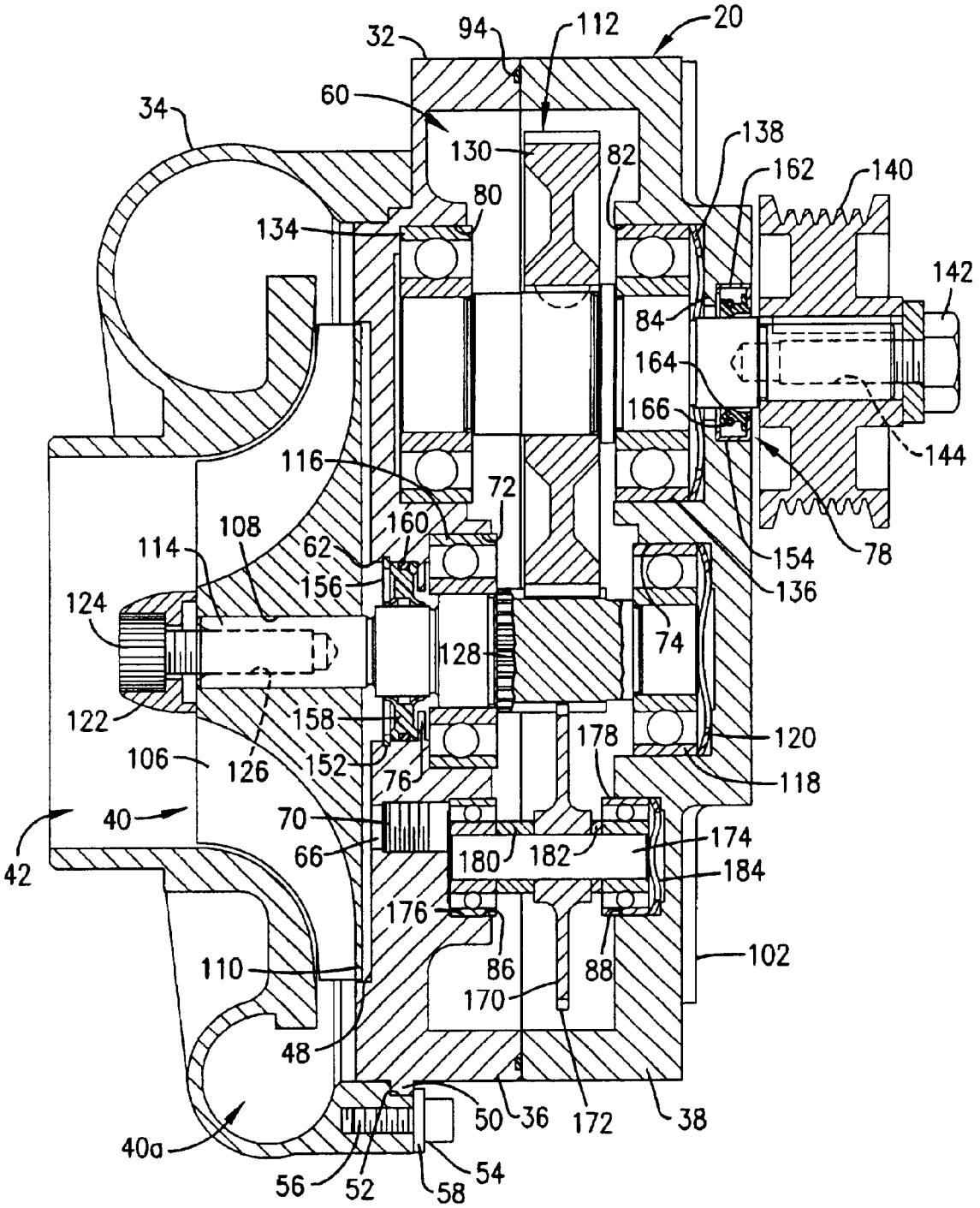
FIG. 4 is an even further enlarged cross-sectional view of the supercharger taken generally along line 4—4 of FIG. 3, particularly illustrating both the compressor and transmission chambers.

As shown in FIG. 4, the case section 36 presents a circular recess 48 for purposes which will be described. In addition, the section 36 presents an outwardly projecting lip 50 that extends partly around the perimeter thereof (e.g., see FIGS. 2 and 4 ). The lip 50 is received in a complemental groove 52 defined in the case section 34, and a plurality of fastener assemblies 54 serve to secure the case sections 34 and 36 to one another. As particularly shown in FIG. 4, each of the fastener assemblies 54 preferably includes a threaded screw 56 received in the case section 34 and a washer 58 pressed against the lip 50.

Figure 3:
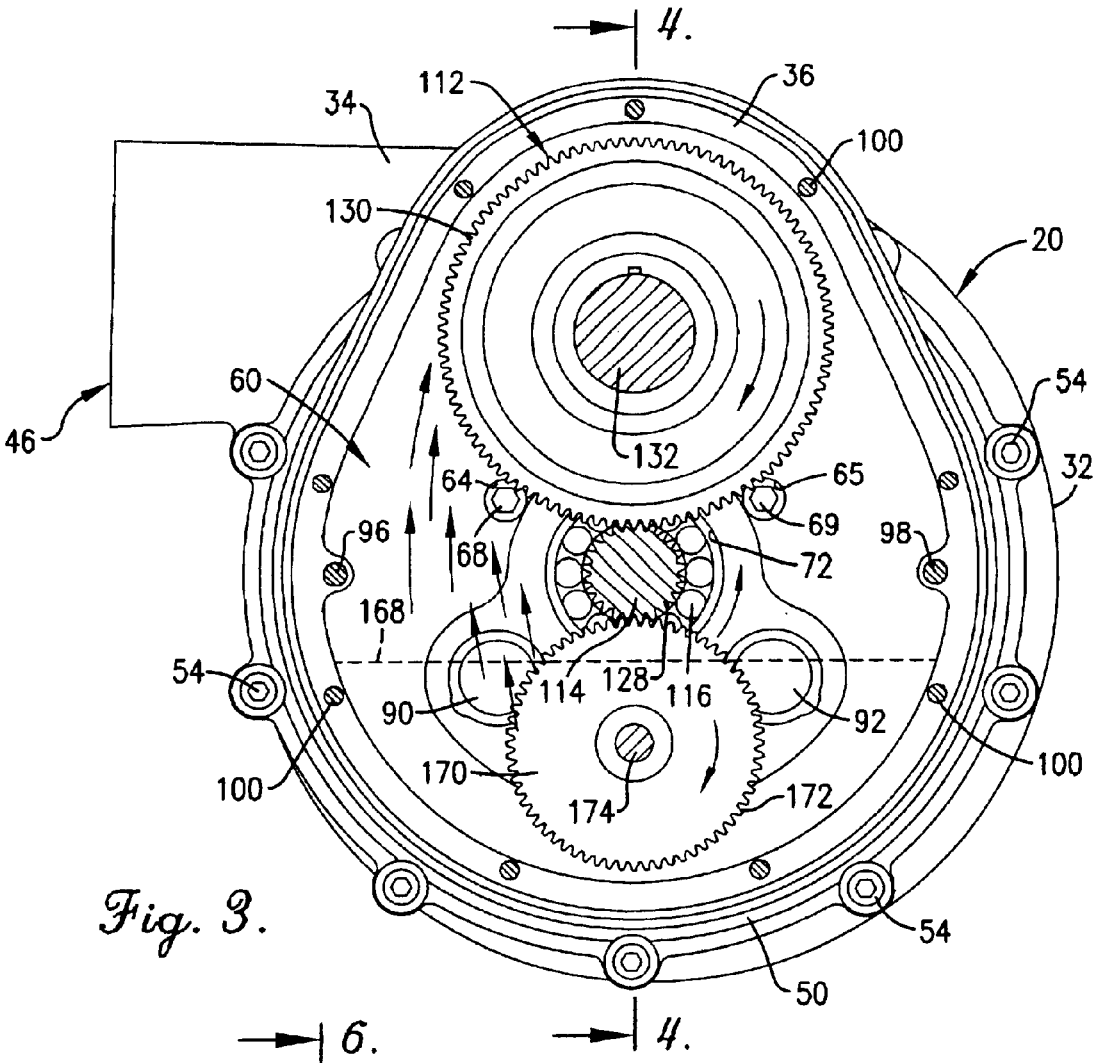
FIG. 3 is an enlarged cross-sectional view of the supercharger taken generally along line 3—3 of FIG. 1, particularly illustrating the transmission chamber and the components located therein.

The middle case section 36 also cooperates with the case section 38 to define a transmission chamber 60 (see FIGS. 3 and 4). As particularly shown in FIG. 3, the transmission chamber 60 is preferably teardrop shaped, with the bottom being wider than the top. An impeller shaft opening 62 that is concentric with the inlet opening 42 extends through the case section 36 from the compressor chamber 40 to the transmission chamber 60. A set of internally threaded passageways 64,65,66 also extend through the case section 36, with each of the passageways 64,65,66 normally being sealed by a respective threaded plug 68,69,70. Except for the shaft opening 62 and the passageways 64,65,66, the chambers 40 and 60 are otherwise separated from one another by the case section 36. Defined in the case sections 36 and 38 in axial alignment with the shaft opening 62 are a pair of opposed bearing assembly sockets 72 and 74. An inwardly projecting dividing wall 76 is located along the shaft opening 62 to present a seal recess for purposes which will be described.

The case section 38 similarly includes an input shaft opening 78 that is spaced upwardly from the bearing assembly socket 74. Similar to the impeller shaft opening 62, the input shaft opening 78 is axially aligned with opposed bearing assembly sockets 80 and 82 defined in the case sections 36 and 38. There is likewise an inwardly projecting dividing wall 84 alongside the bearing assembly socket 82 to present a seal recess as will be described. In the preferred embodiment, a pair of opposed, relatively small bearing assembly sockets 86 and 88 defined in the case sections 36 and 38 are utilized, although two additional pairs of sockets 90 and 92 (only the sockets defined in the case section 36 being shown in FIG. 3) are provided in the transmission chamber 60. As will be described, the three pairs of sockets permit the supercharger to be mounted at various angles, while ensuring sufficient and effective dispersion of lubrication fluid within the transmission chamber 60. It is noted that the passageway 66 projects from the center socket 86 (see FIG. 4).

An endless O-ring 94 retained within a continuous groove defined in the case section 36 provides a seal between the case sections 36 and 38 (see FIG. 4). A pair of alignment rods 96 and 98 (see FIG. 3) ensure proper positioning of the case sections 36 and 38 relative to one another, as well as a series of attachment screws 100 (see also FIG. 2).

As particularly shown in FIG. 2, the illustrated case section 38 presents a finned outer face 102 for promoting heat exchange between the transmission chamber, particularly the lubrication fluid, and atmosphere. The outer face 102 is also provided with a plurality of mounting bosses 104, each being tapped so that a mounting bolt (not shown) may be threaded therein to fasten the supercharger 20 to a mounting bracket (also not shown) fixed to the engine 22.

In the usual manner, the supercharger 20 includes a rotatable impeller 106 located within the compressor chamber 40 (see FIG. 4). The impeller 106 is preferably machined from a billet of 7075 T-6 aircraft aluminum, although other suitable materials (e.g., cast aluminum) may be used. It is further preferred to use the impeller commercially available from the assignee of record of the invention claimed herein. However, the impeller 106 may be variously configured without departing from the spirit of the present invention. With respect to the preferred embodiment, the impeller 106, regardless of its design, induces and causes fluid to flow through the compressor chamber 40 as hereinabove described. It is particularly noted that the impeller 106 is provided with a central mounting hole 108. In addition, the impeller 106 has a circular, solid base 110 that spans and is received in the recess 48.

The impeller 106 is drivingly connected to the belt drive 26 of the engine 22 by a transmission 112 located generally in the transmission chamber 60. The transmission 112 may be variously configured but at least some component(s) thereof require(s) continuous lubrication during operation.

In the preferred embodiment, the transmission 112 includes an impeller shaft 114 rotatably supported by a pair of bearing assemblies 116 and 118 press fit within respective ones of the sockets 72 and 74. In the usual manner, a wavy spring washer 120 is provided in at least one of the sockets 72 and 74. As is sometimes common because of the extremely high rotational speeds of the impeller 106, additional bearing assemblies (not shown) may be used to support the impeller shaft 114. The construction of the various bearing assemblies used in the illustrated supercharger 20 will not be described in detail, with the understanding that each illustrated assembly includes an inner race suitably fixed (e.g., press fit) to the shaft rotatably supported by the assembly, an outer race suitably fixed to the case section to which the assembly is mounted, and a ball and cage assembly retained between the races. Furthermore, the illustrated bearing assemblies are not prelubricated and require continuous lubrication during operation. However, the principles of the present invention are equally applicable to various other types of bearing assemblies (e.g., prelubricated bearing assemblies, ceramic balls, rolling bearings, tapered bearings, etc.).

The illustrated impeller shaft 114 projects through the opening 62 and into the compressor chamber 40. The mounting hole 108 of the impeller 106 receives the end of the shaft 114 therein, with the impeller 106 preferably being pressed onto the shaft 114 and retained thereon by a cap 122. It is noted that the cap 122 is secured in place by a screw 124 threaded into an axial bore 126 of the shaft 114. When it is desired to remove the impeller 106, the outer case section 34 is detached from the middle case section 36, the retaining screw 124 and cap 122 are removed, the plugs 68,69,70 are unscrewed from their respective passageways 64,65,66, and a tool may then be inserted through one or all of the passageways 68,69,70 to engage the impeller base 110 and force the impeller 106 off the end of the shaft 114.

The impeller shaft 114 is preferably machined to include a pinion 128 located between the bearing assemblies 116 and 118. The pinion 128 intermeshes with a relatively larger gear 130 supported by an input shaft 132. The gear 130 is preferably keyed to the shaft 132, although these components may be fixedly interconnected in any other suitable manner. Similar to the impeller shaft 114, a pair of bearing assemblies 134 and 136 press fit within respective ones of the sockets 80 and 82 rotatably support the input shaft 132. Additionally, a wavy spring washer 138 is provided in the socket 82 adjacent the dividing wall 84. The input shaft 132 projects through the shaft opening 78 and beyond the outer face 102 of the case section 38. The belt drive 26 includes a driven sheave 140 keyed to the outwardly projecting portion of the input shaft 132. The driven sheave 140 is further retained on the shaft 132 by a screw 142 threaded into an axial bore 144 of the shaft 132. The illustrated belt drive 26 further includes a drive sheave 146 fixed to the crank shaft 24, a belt 148 entraining the sheaves 140 and 146, and an idler sheave 150 suitably tensioning the belt 148. Thus, rotation of the crank shaft 24 effects rotation of the impeller 106.

Those ordinarily skilled in the art will appreciate that the gear-type transmission 112 of the preferred embodiment produces noise that is noticeably greater than a belt drive. It has been determined that the impeller 106 actually amplifies the noise of the transmission 112, and the noise typically associated with a gear driven supercharger is normally considered undesirable. In this regard, the impeller shaft 114 is preferably designed to dampen noise that might otherwise propagate through the shaft 114 to the impeller 106. Such a shaft construction is disclosed in contemporaneously filed application for U.S. patent Ser. No. 09/669,018, filed Sep. 22, 2000, entitled GEAR DRIVEN SUPERCHARGER HAVING NOISE REDUCING IMPELLER SHAFT, which is hereby incorporated by reference herein as is necessary for a full and complete understanding of the present invention.

Because lubrication fluid will be dispersed throughout the transmission chamber 60 in the manner described below, seal assemblies 152 and 154 are provided at the shaft openings 68 and 78, respectively. Turning first to the impeller shaft seal assembly 152, a retaining ring 156 maintains a seal 158 against the dividing wall 76. The seal 158 is provided with a circumferential O-ring 160 that sealingly engages the case section 34. The seal 158 is formed of any suitable material, such as that available under the designation "TEFLON", and preferably provides double or redundant sealing contact with the impeller shaft 114. On the other hand, the input shaft seal assembly 154 includes a metal case 162 press fit within the case section 38 against the dividing wall 84. The case 162 houses a rubber seal 164 that is sealingly retained between the input shaft 132 and case 162 by a spring 166. The illustrated seal assemblies 152 and 154 are preferred but shall be considered as illustrative only, and the principles of the present invention are equally applicable to a supercharger using various other types of seals.

Those ordinarily skilled in the art will appreciate that the gears 128,130 and, in the preferred embodiment, the bearing assemblies 116,118,134,136 require lubrication during operation. The supercharger 20 is preferably self-contained such that the lubrication fluid is maintained within the transmission chamber 60. As shown in FIG. 3, the illustrated supercharger 20 is oriented so that the gears 128 and 130 are arranged along a vertical centerline of the transmission chamber 60, and the pinion 128 is spaced well above the lowermost boundary of the transmission chamber 60. The portion of the transmission chamber 60 below the sockets 72,74 preferably defines a fluid reservoir that is filled with lubrication fluid. In this regard, all of the illustrated transmission is located above or outside the fluid reservoir portion of the chamber 60, although it is entirely within the ambit of the present invention to submerge part of the transmission if desired. For example, if the bearing assemblies 116 and 118 for the impeller shaft 114 are alternatively lubricated by some other means (e.g., they are prelubricated), the top of the fluid reservoir portion is preferably located at or just below the pinion 128. As will be described with respect to an alternative embodiment of the present invention, it is also possible to partly submerge one of the gears of the transmission, although the partly submerged gear is preferably rotated at a relatively low speed and not directly intermeshing with the high speed components (e.g., the pinion on the impeller shaft) of the transmission. It is, however, most preferred that the transmission 112 be located entirely outside the reservoir portion of the transmission chamber. This helps in reducing the risk of flooding the lubricated components of the transmission 112 with lubricant and thereby subjecting these components to excessive hydraulic separation forces.

A dashed line 168 in FIG. 3 represents the top boundary of the reservoir portion of the transmission chamber 60, as well as the surface of the fluid contained within the transmission chamber 60. That is to say, the quantity of fluid within the transmission chamber 60 essentially defines the fluid reservoir portion. The case may be provided with a window (not shown) that allows the user to view the fluid level. In addition, the case may be provided with normally closed fluid drain and fluid fill openings (not shown) communicating with the transmission chamber 60 to facilitate changing of the lubrication fluid, replenishment of the fluid, etc.

Moreover, the supercharger 20 is provided with a device or pump for propelling lubrication fluid to the transmission 112. In the embodiment illustrated in FIGS. 1–4, the device or pump comprises a circular fluid-slinging disc 170 partly submerged within the lubrication fluid, such that rotation of the disc 170 causes lubrication fluid to be dispersed throughout the upper portion of the transmission chamber 60 (i.e., the portion of the chamber 60 above the fluid surface). The illustrated disc 170 includes a toothed outer edge 172 that is specifically configured to intermesh with the pinion 128 (see FIG. 3), whereby rotation of the pinion 128 effects rotation of the disc 170. As shown in FIG. 4, the disc 120 is suitably fixed (i.e., press fit) to a shaft 174 and positioned between a pair of bearing assemblies 176 and 178 by respective spacers 180 and 182. The bearing assemblies 176 and 178 are press fit within respective ones of the sockets 86 and 88 and thereby serve to rotatably support the shaft 174 and disc 170 within the transmission chamber 60. If desired, the bearing assemblies 176 and 178 may be sealed from the fluid reservoir so that lubrication fluid from the reservoir does not flood, have direct ingress to, or otherwise affect operation of the assemblies 176 and 178. As with the other shaft assemblies, a wavy spring washer 184 is provided in the socket 88 adjacent the bearing assembly 178.

Because the illustrated supercharger 20 is disposed in the vertical orientation, the slinging disc 170 is preferably mounted between the lower, central sockets 86 and 88. However, it is entirely within the ambit of the present invention to alternatively mount the disc 170 between either pair of the other sockets 90 or 92. Such alternative mounting is particularly preferred if the supercharger 20 is mounted to the engine 22 in such a manner that the transmission chamber 60 is angularly offset relative to vertical. For example, if the supercharger 20 is mounted so that the transmission chamber 60 has been rotated in a clockwise direction compared to its upright orientation in FIG. 3, the disc 170 is desirably mounted between the pair of sockets 92. It will be appreciated that this ensures that the disc 170 is sufficiently submerged within lubricant to effect the desired lubrication of the transmission 112, without causing the impeller shaft bearing assemblies 116 and 118 to be submerged.

As shown in FIG. 3, the slinging disc 170 is preferably partly submerged such that a portion of the disc 170 projects upwardly out of the fluid. The amount the illustrated disc 170 projects out of the fluid will increase to some extent during operation, as a result of some of the fluid being dispersed throughout the transmission chamber 60. In the embodiment illustrated in FIGS. 1–4, the disc is approximately two and one-half inches in diameter and the above-surface segment is defined about an arc of approximately 95 E; however, the dimension of the disc 170 and the degree to which it is submerged may vary as desired. For example, the slinging disc 170 need not be circular in shape, although it is preferred that the disc 170 be symmetric about its rotational axis. It may also be possible to completely submerge the slinging disc 170. For example, the supercharger 20 may be arranged so that the disc 170 is completely submerged but has sufficient displacement capability to propel fluid to those components of the transmission 112 requiring lubrication.

The operation of the engine 22 will cause the input shaft 132 to be rotated by the belt drive 26. The large gear 130 is consequently rotated as illustrated in FIG. 3, and the pinion is rotated in an opposite direction. The impeller 106 is rotated at incredibly high speeds (e.g., 40,000 to 80,000 rpm) to produce an extremely large amount of horsepower (e.g., 1800 gasoline hp).

Further, the slinging disc 170 is rotated in the same direction as the large gear 130. It is believed that at relatively slow speeds the toothed edge 172 of the disc 170 carries lubrication fluid to the pinion 128 and the fluid is in turn transferred to the large gear 130. The bearing assemblies 116,118,134,136 are believed to be lubricated by fluid pressed outwardly by the intermeshing contact of the disc 170 and pinion 128 and the pinion 128 and larger gear 130, as well as fluid being flung from the gears 128,130. Moreover, at relatively higher speeds, the disc 170 eventually creates a fluid mist that migrates throughout the entire upper portion of the transmission chamber 60 and lubricates all of the transmission components therein. Such an environment is highly desirable with the illustrated high speed transmission. It is also believed that the point at which the disc 170 creates the mist environment depends on the viscosity of the lubrication fluid and the relative velocity of the disc 170. This point is further believed to correspond with a cavitation state of the rotating disc 170. With respect to the preferred embodiment, the fluid reservoir is filled with any suitable lubrication fluid (e.g., oil, synthetic lubrication fluids, etc.). As a result of the size/diameter ratios of the sheaves 140,146 and gears 128,130, the speed of the disc 170 is significantly greater than the speed of the crankshaft 24. In the preferred embodiment, the rotational speed of the disc 170 ranges between zero and twenty-thousand revolutions per minute. It is also noted that the teeth of the edge 172 enhance the lubricant slinging action of the disc 170.

Rotation of the slinging disc 170, particularly when the disc is creating the mist environment, requires negligible power and the heat generated by disc 170 is also insignificant. It is believed that this is at least partly attributable to the fact that the disc 170 rotates at such high speeds and the lubricant has no opportunity to completely fill the voids defined between the teeth of the outer edge 172. Those ordinarily skilled in the art will appreciate that the mist environment created by the disc 172 provides "low pressure" lubrication to the transmission 112, which is believed to be highly desirable for the bearing assemblies 116,118, 134,136 and, to a lesser extent, the gears 128,130. That is to say, the slinging disc 170 does not flood the transmission 112 or cause the transmission to be excessively lubricated. Finally, the operating load of the disc 170, and therefore the shaft 174 and bearing assemblies 176 and 178, is relatively low and these components need not have expensive, high strength constructions (e.g., the slinging disc 170 may have a minimum thickness of approximately one-twentieth inch).

It is noted that the principles of the present invention are equally applicable to various other supercharger configurations and alternative lubricant slinging devices. For example, the lubricant reservoir need not be located directly below the transmission 112. If desired, the reservoir portion of the transmission chamber could be laterally offset from the transmission, with the slinging disc being arranged to direct the lubrication fluid laterally toward the transmission. The configuration of the transmission chamber 60 may also be varied, although the illustrated shape is believed to most effectively enhance fluid flow to the lubricated transmission components. The transmission 112 itself may also be variously configured (e.g., the principles of the present invention are equally applicable to any transmission having at least one component that requires lubrication during operation and that has not been prelubricated). As previously noted, the transmission 112 provides driving connection between the impeller 106 and the belt drive 26; such that driving power is transferred from the input 132 shaft (connected to the belt drive 26), through the gears 128 and 130, and to the impeller shaft 114. The disc 170 is preferably outside the driving connection of the transmission so that at least substantially no driving power is transferred to the impeller 106 by the disc 170. With particular respect to the illustrated embodiment, the disc 170 is not drivingly connected between the belt drive 26 and the impeller 106. It is also possible to drive the slinging disc in some alternative manner, rather than having it drivingly contact one of the transmission components. For example, the slinging disc may alternatively be driven by a separate drive or indirectly drivingly coupled to the transmission by a drive train that is not transferring power from the power input source to the impeller. The device for directing lubricant to the transmission may be further varied, as it is only critical that the device be capable of propelling lubricant from a reservoir portion of the transmission chamber to those components outside the reservoir portion requiring lubrication.

Figure 5:
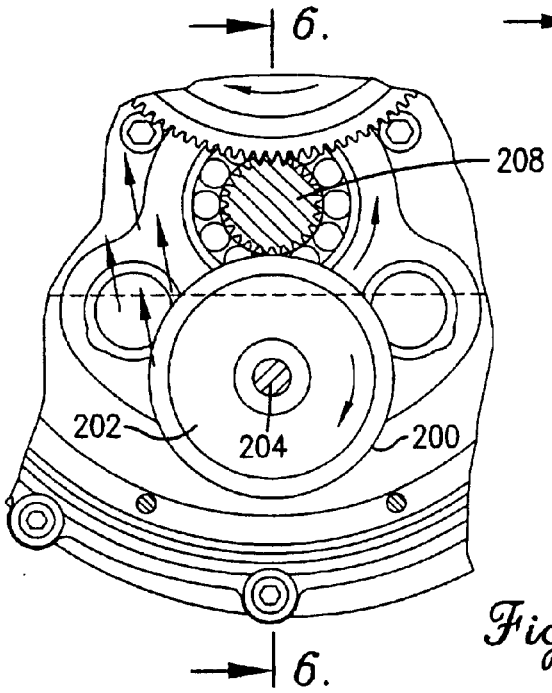
FIG. 5 is a greatly enlarged, fragmentary cross-sectional view of a second embodiment of the present invention, wherein the rotatable fluid-propelling element comprises a wheel having an outer tire that engages the pinion gear of the impeller shaft.
Figure 6:
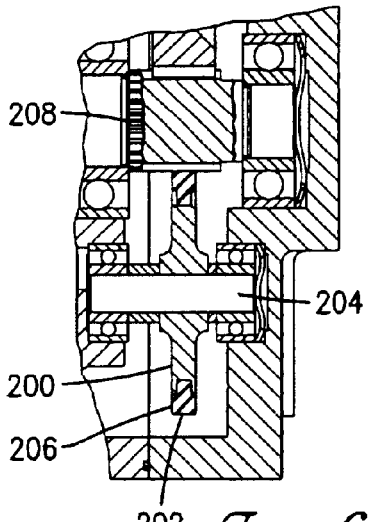
FIG. 6 is a fragmentary cross-sectional view taken generally along line 6—6 of FIG. 5.

One possible alternative of the lubricant slinging device is shown in FIGS. 5 and 6. Particularly, the device comprises a wheel 200 including a hub 202 fixed to the shaft 204 and a tire 206 mounted to the hub 202. The tire 206 is formed of any suitable material (e.g., ultra-high molecular weight polyethylene, rubber, etc). Moreover, the tire 206 contacts the periphery of the pinion 208, such that rotation of the pinion 208 causes the wheel 200 to be rotated.

Figure 7:
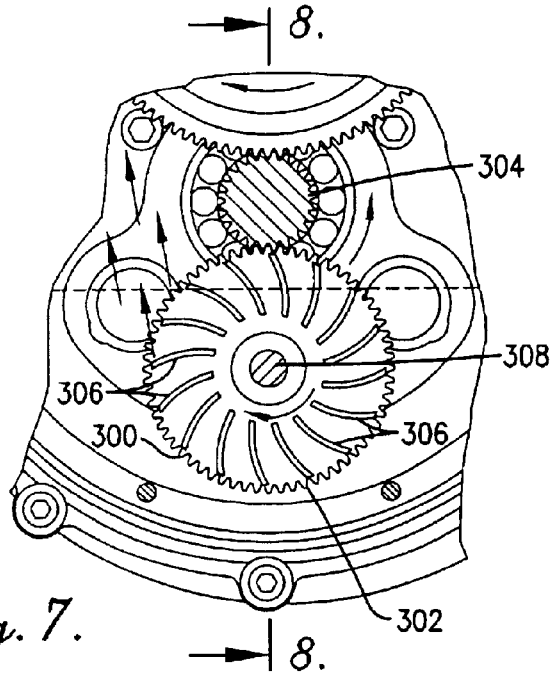
FIG. 7 is a greatly enlarged, fragmentary cross-sectional view of a third embodiment of the present invention, wherein the rotatable fluid-propelling element comprises a disc intermeshing with the pinion gear of the impeller shaft and having a plurality of vanes projecting from one side thereof.
Figure 8:
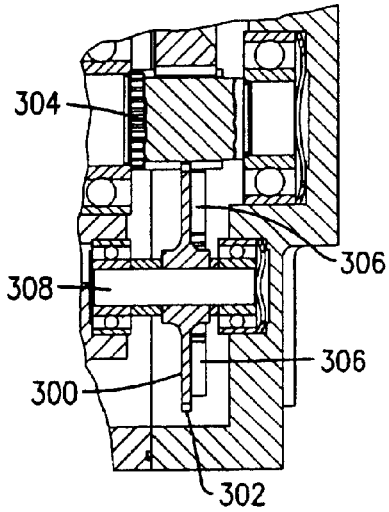
FIG. 8 is a fragmentary cross-sectional view taken generally along line 8—8 of FIG. 7.

In FIGS. 7 and 8, a third embodiment of the present invention is shown, wherein a disc 300 is provided with a toothed outer periphery 302 that intermeshes with the pinion 304. Projecting from one side of the disc 300 are a plurality of angularly spaced vanes 306, although both sides of the disc 300 may alternatively be vaned. As perhaps best shown in FIG. 7, each of the vanes 306 curves radially outward relative to the shaft 308 in a direction opposite to the direction of rotation. It will be appreciated that the orientation of the vanes 306 reduces the power that might otherwise be consumed to rotate the disc 300, yet the slinging action of the disc 300 is still enhanced compared to the first embodiment. The disc 300 may be machined, cast or otherwise formed of any suitable material (e.g., metal, high-strength plastic, etc.).

Figure 9:
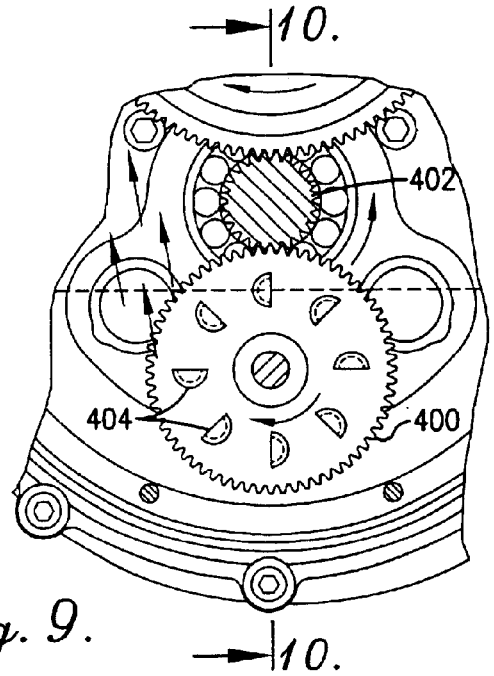
FIG. 9 is a greatly enlarged, fragmentary cross-sectional view of a fourth embodiment of the present invention, wherein the rotatable fluid-propelling element comprises a disc intermeshing with the pinion gear of the impeller shaft and having a plurality of bowl-shaped projections extending from one side thereof.
Figure 10:
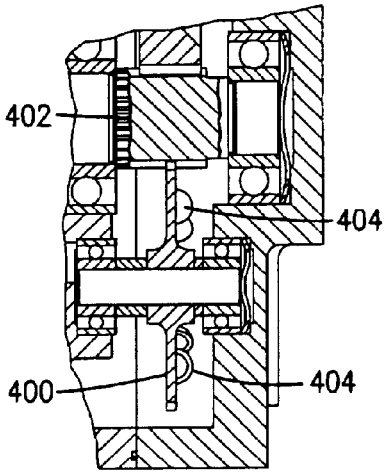
FIG. 10 is a fragmentary cross-sectional view taken generally along line 10—10 of FIG. 9.

Yet another embodiment of the present invention is shown in FIGS. 9 and 10. Similar to the embodiments shown in FIGS. 1–4 and 7–8, this embodiment involves a slinging disc 400 that intermeshes with the pinion 402. However, the disc 400 is provided with a plurality of angularly spaced bowl-shaped elements 404. If desired, both sides of the disc 400 may be provided with the elements 404. The disc 400 is formed of any suitable material. It is noted that the each of the illustrated elements 404 is generally in the shape of one quadrant of a hollow sphere, with the open cavity defined thereby facing the direction of rotation. Such an arrangement will consume more power than the other illustrated embodiments, however, the fluid displacement is believed to be significantly greater.

Figure 11:
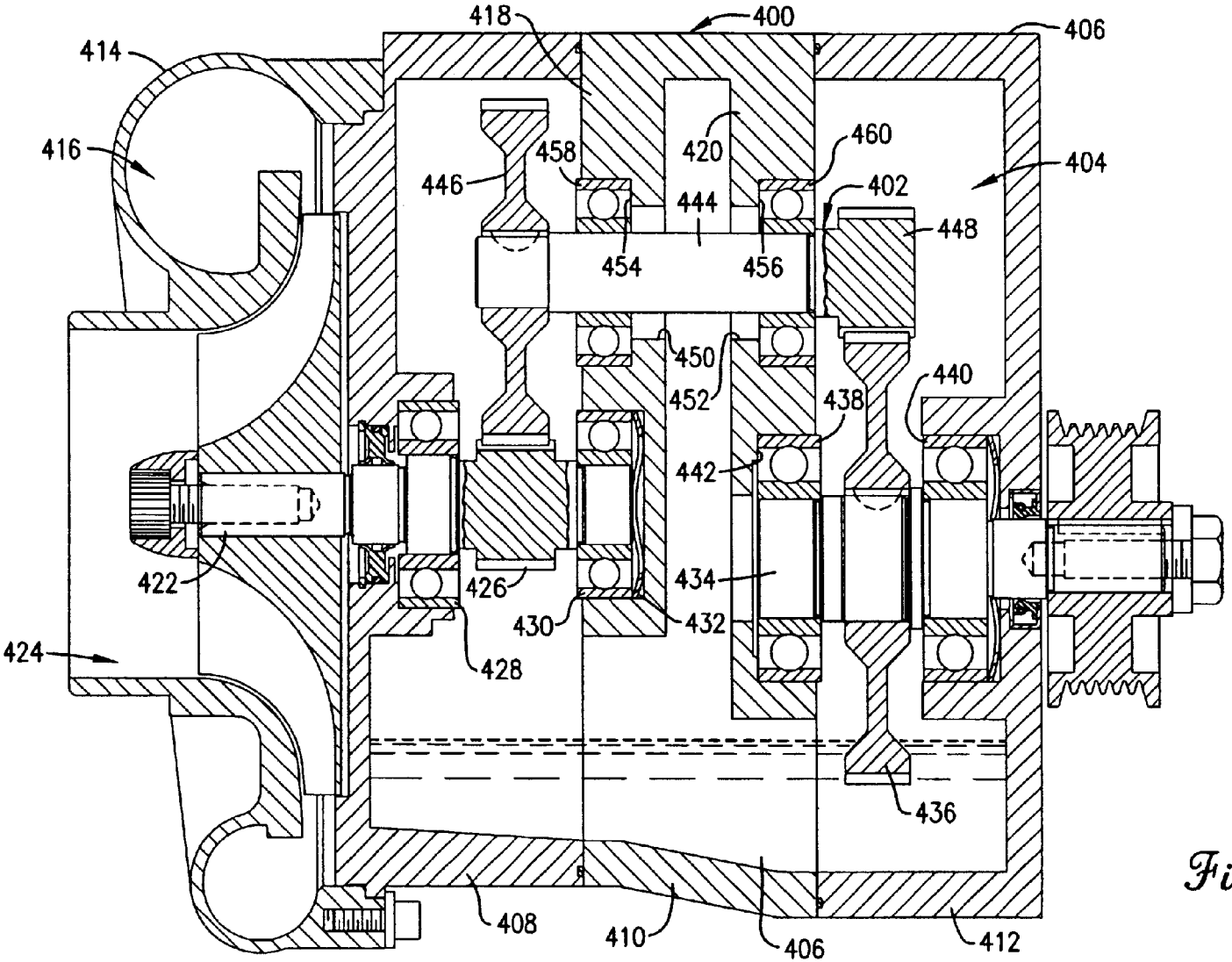
FIG. 11 is a cross-sectional view of a fifth embodiment of the present invention, wherein the lubricant slinging element is the drive gear fixed to the input shaft of the supercharger.

The final illustrated embodiment of the present invention comprises a supercharger 400 that utilizes one of the gears of the transmission 402 to lubricate the transmission components located in the transmission chamber 404 but outside the reservoir portion 406 of the chamber 404. It is initially noted that the supercharger 400 is similar to the supercharger 20 shown in FIGS. 1–4, except for several important distinctions which will subsequently be described. It shall therefore be sufficient to describe the embodiment shown in FIG. 11 primarily with respect to these distinctions.

In particular, the case 406 includes three case sections 408,410,412 defining the transmission chamber 404 and a final case section 414 cooperating with the section 408 to define the compressor chamber 416. Similar to the previous embodiments, the transmission chamber 404 is preferably vertically oriented and teardrop shaped in cross-section so that the reservoir portion 406 is located at the bottom of the chamber 404. The intermediate transmission case section 410 includes two downwardly projecting spokes 418 and 420 that extend from the top of the section 410. The spokes 418,420 are each as thin in cross-sectional shape as possible to minimize their interference with lubricant dispersion throughout the transmission chamber 404. The case sections 408,410,412 are interconnected by suitable means (e.g., threaded fasteners).

Similar to the previous embodiments, the impeller shaft 422 is rotatably supported in a concentric relationship with the inlet 424 to the compressor chamber 416. In addition, the shaft 422 includes a pinion 426 machined thereon and is supported by a pair of bearing assemblies 428 and 430 located within the transmission chamber 404. However, in this embodiment, the bearing assembly 430 is positioned within a socket 432 defined in the lower region of the spoke 418.

The input shaft 434 is also similar to that shown in the previous embodiments. Particularly, the shaft 434 carries a drive gear 436 keyed thereto and is rotatably supported by a pair of bearing assemblies 438 and 440. However, the input shaft 434 is positioned much lower in the transmission chamber 404 (compare FIGS. 4 and 11) for purposes which will be described. Furthermore, the bearing assembly 438 is disposed within a socket 442 defined in the lower region of the spoke 420. It is also noted that the drive gear 436 and pinion 426 are not directly connected; that is, the gears 426 and 436 do not intermesh to directly transfer power from the input shaft 434 to the impeller shaft 422.

Instead, the transmission 402 includes an intermediate shaft 444 that is preferably located in the upper portion of the chamber 404 and provided with gears 446 and 448. The gear 446 is preferably keyed to the shaft 444 and, more important, intermeshes with the pinion 446 of the impeller shaft 422. The gear 448 is machined on the shaft 444 in the illustrated embodiment. Moreover, the gear 448 intermeshes with the drive gear 446. The shaft 444 and gears 446,448 consequently transmit power from the input shaft 434 to the impeller shaft 422. It is further noted that the gear ratios are such that the transmission 402 provides a significant step up in rotational speed between the input shaft 434 and impeller shaft 422. For example, the input shaft 434 ranges in rotational speeds of zero to 15,000 rmp, while the rotational speed of the illustrated impeller shaft 422 is three (3) to six (6) times that of the input shaft 434. In other words, the illustrated impeller shaft can reach speeds of about 90,000 rpm. In the preferred embodiment, the drive gear 446 has a diameter of about two (2) to three (3) inches.

Preferably, the intermediate shaft 444 projects through openings 450 and 452 defined in the spokes 418 and 420. The spoke 418 includes a socket 454 concentric with the opening 450, and the spoke 420 similarly includes a socket 456 concentric with the opening 452. Ball bearing assemblies 458 and 460 received in the sockets 454 and 456, respectively, rotatably support the intermediate shaft 444 in the desired manner.

The shafts 422,434,444, gears 426,446,448 and bearing assemblies 428,430,438,440,458,460 are all preferably located outside of the reservoir portion 406 of the transmission chamber. That is, these transmission components are preferably not submerged in the lubricant. However, the drive gear 436 does project into the reservoir portion 406 and is preferably only partly submerged within the lubricant. Rotation of the drive gear 436 consequently causes lubricant to be dispersed throughout the transmission chamber 404 and, most preferably, does so by creating a fine mist as described hereinabove.

It is noted that the illustrated arrangement does not produce or experience the untoward hydraulic separation forces which are known to adversely affect transmissions submerged wholly or partly in lubricant. This is believed to be attributable to the fact that the drive gear 446 is rotated at relatively low speeds and does not directly intermesh with the high speed components (e.g., the pinion 426) of the transmission 402. In other words, only the low speed rotatable component(s) of the transmission are submerged and such component(s) are not directly drivingly connected to the high speed component(s) of the transmission. Furthermore, the drive gear 446 is not in the same plane with the high speed components (lubrication of these components requires lateral displacement of lubricant relative to the gear 446).

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of the present invention as pertains to any apparatus not materially departing from but outside the literal scope of the invention as set forth in the following claims.

What is claimed is:

1. A compressor comprising:

a case presenting a compressor chamber and a transmission chamber, said transmission chamber having a fluid reservoir portion;

lubrication fluid contained entirely within the transmission chamber and filling only the fluid reservoir portion thereof;

a rotatable impeller in the compressor chamber;

a transmission operable to drivingly connect the impeller to a power source, with at least part of the transmission being located in the transmission chamber but outside the fluid reservoir portion thereof; and a fluid-propelling element operable to propel lubrication fluid in the fluid reservoir portion of the transmission chamber to said at least part of the transmission.

2. The compressor as claimed in claim 1, said transmission including an impeller shaft that extends from the transmission chamber into the compression chamber to support the impeller, said transmission further including an input shaft that projects from the transmission chamber outside the case for connection to the power source.

3. The compressor as claimed in claim 2, each of said shafts being rotatably supported by a pair of bearing assemblies that are located within the transmission chamber.

4. The compressor as claimed in claim 3, said pair of bearing assemblies being said at least part of the transmission.

5. The compressor as claimed in claim 2, said transmission including a drive gear fixed relative to the input shaft and a driven gear provided on the impeller shaft, said gears being located within the transmission chamber and drivingly connected so that power from the input shaft is transferred to the impeller shaft.

6. The compressor as claimed in claim 1, said fluid-propelling element being rotatable and located at least partly in the fluid reservoir portion of the transmission chamber, such that rotation of the fluid-propelling element causes lubrication fluid in the fluid reservoir portion to be slung to said at least part of the transmission.

7. The compressor as claimed in claim 6, said transmission including a plurality of intermeshing gears, said fluid-propelling element including circumferential teeth that intermesh with one of the gears of the transmission so that rotation of the one gear effects rotation of the fluid-propelling element.

8. The compressor as claimed in claim 1, said fluid reservoir portion of the transmission chamber being positioned below said at least part of the transmission, said fluid-propelling element being rotatable and located at least partly in the fluid reservoir portion, such that rotation of the fluid-propelling element causes lubrication fluid in the fluid reservoir portion to be slung upwardly to said at least part of the transmission.

9. The compressor as claimed in claim 8, said transmission chamber being generally teardrop-shaped in cross-section, with the fluid reservoir portion being wider in cross-section than any other portion of the transmission chamber.

10. The compressor as claimed in claim 1, said fluid-propelling element being rotatable and located at least partly in the fluid reservoir portion of the transmission chamber, such that rotation of the fluid-propelling element causes lubrication fluid in the fluid reservoir portion to be slung to said at least part of the transmission, said fluid-propelling element being rotatably supported by a pair of bearing assemblies, said case presenting multiple pairs of opposed aligned mounting sockets, with the bearing assemblies being received in respective mounting sockets of one of the pairs.

11. A compressor comprising:

a case presenting a compressor chamber and a transmission chamber, said transmission chamber having a fluid reservoir portion, a rotatable impeller in the compressor chamber; and a transmission operable to drivingly connect the impeller to a power source, with at least part of the transmission being located in the transmission chamber but outside the fluid reservoir portion thereof, said transmission including a rotatable element located at least partly in the fluid reservoir portion of the transmission chamber, such that rotation of the element causes lubrication fluid in the fluid reservoir portion to be slung to said at least part of the transmission, said transmission including an impeller shaft that extends from the transmission chamber into the compression chamber to support the impeller, said transmission further including an input shaft that projects from the transmission chamber outside the case for connection to the power source, said transmission further including an intermediate shaft drivingly connected between the impeller and input shafts.

12. The compressor as claimed in claim 11, each of said shafts being rotatably supported by a pair of bearing assemblies that are located within the transmission chamber.

13. The compressor as claimed in claim 12, said pair of bearing assemblies being said at least part of the transmission.

14. The compressor as claimed in claim 13, said transmission including a drive gear fixed relative to the input shaft, a driven gear provided on the impeller shaft, and intermediate gears each provided on the intermediate shaft and intermeshing with a respective one of the drive and driven gears, said drive gear being said element.

15. The compressor as claimed in claim 14, said shaft, bearings therefor, and driven and intermediate gears being said at least part of the transmission.

16. A compressor comprising:

a case presenting a compressor chamber and a second chamber having a fluid reservoir portion;

a rotatable impeller in the compressor chamber;

lubrication fluid contained entirely within the second chamber and filling only the fluid reservoir portion thereof;

a rotatable shaft;

a bearing assembly rotatably supporting the shaft on the case, said bearing assembly being located outside the fluid reservoir portion of the second chamber; and a rotatable fluid-propelling element located at least partly in the fluid reservoir portion and operable to propel lubrication fluid in the fluid reservoir portion of the second chamber toward the bearing assembly when rotated.

17. The compressor as claimed in claim 16, at least a portion of said rotatable shaft being located in the compressor chamber.

18. The compressor as claimed in claim 16, said impeller being supported on the rotatable shaft.

19. A compressor comprising:

a case presenting a compressor chamber and a transmission chamber, said transmission chamber having a fluid reservoir portion configured to hold a quantity of lubrication without filling the transmission chamber;

a rotatable impeller in the compressor chamber;

a transmission operable to drivingly connect the impeller to a power source such that the transmission serves to transfer driving power to the impeller, said transmission being located generally within in the transmission chamber but at least substantially outside the fluid reservoir portion thereof; and a rotatable fluid-propelling element located at least partly in the fluid reservoir portion of the transmission chamber, with rotation of the fluid-propelling element causing lubrication fluid in the fluid reservoir portion to be transferred to the transmission, said fluid-propelling element being outside the driving connection between the impeller and power source so that at least substantially no driving power is transferred to the impeller by the fluid-propelling element.

20. The compressor as claimed in claim 19; and lubrication fluid contained entirely within the transmission chamber and filling only the fluid reservoir portion thereof.

21. The compressor as claimed in claim 19, said transmission including a generally cylindrical rotatable member, said fluid-propelling element presenting an outer, generally circular surface that engages the member so that rotation of the member effects rotation of the fluid-propelling element.

22. The compressor as claimed in claim 21, said transmission including a plurality of intermeshing gears, one of which is said rotatable member, said fluid-propelling element including circumferential teeth that intermesh with said one of the gears of the transmission so that rotation of the one gear effects rotation of the fluid-propelling element.

23. The compressor as claimed in claim 19, said transmission including an impeller shaft that extends from the transmission chamber into the compression chamber to support the impeller, said transmission further including an input shaft that projects from the transmission chamber outside the case for connection to the power source.

24. The compressor as claimed in claim 23, each of said shafts being rotatably supported by a pair of bearing assemblies that are located within the transmission chamber.

25. The compressor as claimed in claim 23, said transmission including a drive gear fixed relative to the input shaft and a driven gear provided on the impeller shaft, said gears being located within the transmission chamber and drivingly connected so that power from the input shaft is transferred to the impeller shaft.

26. The compressor as claimed in claim 19, said fluid reservoir portion of the transmission chamber being positioned below the transmission.

27. The compressor as claimed in claim 26, said transmission chamber being generally teardrop-shaped in cross-section, with the fluid reservoir portion being wider in cross-section than any other portion of the transmission chamber.

28. The compressor as claimed in claim 19, said fluid-propelling element being rotatably supported by a pair of bearing assemblies, said case presenting multiple pairs of opposed aligned mounting sockets, with the bearing assemblies being received in respective mounting sockets of one of the pairs.

29. The compressor as claimed in claim 19, said fluid-propelling element presenting an outer circumferential surface, said fluid-propelling element having an outer surface speed of at least about 3,500 feet per minute during rotation of the impeller.

30. A centrifugal supercharger comprising:

a case presenting a compressor chamber and a transmission chamber, said transmission chamber having a fluid reservoir portion;

lubrication fluid contained entirely within the transmission chamber and filling only the fluid reservoir portion thereof;

a rotatable impeller in the compressor chamber;

a transmission operable to drivingly connect the impeller to a power source, with at least part of the transmission being located in the transmission chamber but outside the fluid reservoir portion thereof; and a lubricant pump operable to transfer lubrication fluid in the fluid reservoir portion of the transmission chamber to said at least part of the transmission.

31. The centrifugal supercharger as claimed in claim 30, said transmission including an impeller shaft that extends from the transmission chamber into the compression chamber to support the impeller, said transmission further including an input shaft that projects from the transmission chamber outside the case for connection to the power source.

32. The centrifugal supercharger as claimed in claim 31, each of said shafts being rotatably supported by a pair of bearing assemblies that are located within the transmission chamber.

33. The centrifugal supercharger as claimed in claim 32, said pair of bearing assemblies being said at least part of the transmission.

34. The centrifugal supercharger as claimed in claim 31, said transmission including a drive gear fixed relative to the input shaft and a driven gear provided on the impeller shaft, said gears being located within the transmission chamber and drivingly connected so that power from the input shaft is transferred to the impeller shaft.

35. The centrifugal supercharger as claimed in claim 30, said lubricant pump including a rotatable fluid-propelling element located at least partly in the fluid reservoir portion of the transmission chamber, with rotation of the fluid-propelling element causing lubrication fluid in the fluid reservoir portion to be transferred to said at least part of the transmission.

36. The centrifugal supercharger as claimed in claim 35, said transmission including a plurality of intermeshing gears, said fluid-propelling element including circumferential teeth that intermesh with one of the gears of the transmission so that rotation of the one gear effects rotation of the fluid-propelling element.

37. The centrifugal supercharger as claimed in claim 35, said fluid reservoir portion of the transmission chamber being positioned below said at least part of the transmission.

38. The centrifugal supercharger as claimed in claim 37, said transmission chamber being generally teardrop-shaped in cross-section, with the fluid reservoir portion being wider in cross-section than any other portion of the transmission chamber.

39. The centrifugal supercharger as claimed in claim 35, said fluid-propelling element being rotatably supported by a pair of bearing assemblies, said case presenting multiple pairs of opposed aligned mounting sockets, with the bearing assemblies being received in respective mounting sockets of one of the pairs.

40. The centrifugal supercharger as claimed in claim 35, said fluid-propelling element presenting an outer circumferential surface, said fluid-propelling element having an outer surface speed of at least about 3,500 feet per minute during rotation of the impeller.

41. The centrifugal supercharger as claimed in claim 30, said lubricant pump being outside the driving connection between the impeller and power source so that at least substantially no driving power is transferred to the impeller by the lubricant pump.

42. A compressor comprising:

a case presenting a compressor chamber and a transmission chamber, said transmission chamber having a fluid reservoir portion;

lubrication fluid contained entirely within the transmission chamber and filling only the fluid reservoir portion thereof;

a rotatable impeller in the compressor chamber;

a transmission operable to drivingly connect the impeller to a power source, with at least part of the transmission being located in the transmission chamber but outside the fluid reservoir portion thereof; and a lubricant pump operable to transfer lubrication fluid in the fluid reservoir portion of the transmission chamber to said at least part of the transmission.

43. The compressor as claimed in claim 42, said transmission including an impeller shaft that extends from the transmission chamber into the compression chamber to support the impeller, said transmission further including an input shaft that projects from the transmission chamber outside the case for connection to the power source.

44. The compressor as claimed in claim 43, each of said shafts being rotatably supported by a pair of bearing assemblies that are located within the transmission chamber.

45. The compressor as claimed in claim 44, said pair of bearing assemblies being said at least part of the transmission.

46. The compressor as claimed in claim 43, said transmission including a drive gear fixed relative to the input shaft and a driven gear provided on the impeller shaft, said gears being located within the transmission chamber and drivingly connected so that power from the input shaft is transferred to the impeller shaft.

47. The compressor as claimed in claim 42, said lubricant pump including a rotatable fluid-propelling element located at least partly in the fluid reservoir portion of the transmission chamber, with rotation of the fluid-propelling element causing lubrication fluid in the fluid reservoir portion to be transferred to said at least part of the transmission.

48. The compressor as claimed in claim 47, said transmission including a plurality of intermeshing gears, said fluid-propelling element including circumferential teeth that intermesh with one of the gears of the transmission so that rotation of the one gear effects rotation of the fluid-propelling element.

49. The compressor as claimed in claim 47, said fluid reservoir portion of the transmission chamber being positioned below said at least part of the transmission.

50. The compressor as claimed in claim 49, said transmission chamber being generally teardrop-shaped in cross-section, with the fluid reservoir portion being wider in cross-section than any other portion of the transmission chamber.

51. The compressor as claimed in claim 47, said fluid-propelling element being rotatably supported by a pair of bearing assemblies, said case presenting multiple pairs of opposed aligned mounting sockets, with the bearing assemblies being received in respective mounting sockets of one of the pairs.

52. The compressor as claimed in claim 47, said fluid-propelling element presenting an outer circumferential surface, said fluid-propelling element having an outer surface speed of at least about 3,500 feet per minute during rotation of the impeller.

53. The compressor as claimed in claim 42, said lubricant pump being outside the driving connection between the impeller and power source so that at least substantially no driving power is transferred to the impeller by the lubricant pump.

54. A centrifugal supercharger comprising:

a case presenting a compressor chamber and a transmission chamber, said transmission chamber having a fluid reservoir portion configured to hold a quantity of lubrication without filling the transmission chamber;

a rotatable impeller in the compressor chamber;

a transmission operable to drivingly connect the impeller to a power source such that the transmission serves to transfer driving power to the impeller, said transmission being located generally within in the transmission chamber but at least substantially outside the fluid reservoir portion thereof; and a lubricant pump located at least partly in the fluid reservoir portion of the transmission chamber, said lubricant pump being operable to transfer lubrication fluid in the fluid reservoir portion of the transmission chamber to the transmission, said lubricant pump being outside the driving connection between the impeller and power source so that at least substantially no driving power is transferred to the impeller by the lubricant pump.

55. The centrifugal supercharger as claimed in claim 54; and lubrication fluid contained entirely within the transmission chamber and filling only the fluid reservoir portion thereof.

56. The centrifugal supercharger as claimed in claim 54, said lubricant pump including a rotatable fluid-propelling element located at least partly in the fluid reservoir portion of the transmission chamber, with rotation of the fluid-propelling element causing lubrication fluid in the fluid reservoir portion to be transferred to the transmission.

57. The centrifugal supercharger as claimed in claim 56, said transmission including a generally cylindrical rotatable member, said fluid-propelling element presenting an outer, generally circular surface that engages the member so that rotation of the member effects rotation of the fluid-propelling element.

58. The centrifugal supercharger as claimed in claim 57, said transmission including a plurality of intermeshing gears, one of which is said rotatable member, said fluid-propelling element including circumferential teeth that intermesh with said one of the gears of the transmission so that rotation of the one gear effects rotation of the fluid-propelling element.

59. The centrifugal supercharger as claimed in claim 56, said fluid reservoir portion of the transmission chamber being positioned below the transmission.

60. The centrifugal supercharger as claimed in claim 59, said transmission chamber being generally teardrop-shaped in cross-section, with the fluid reservoir portion being wider in cross-section than any other portion of the transmission chamber.

61. The centrifugal supercharger as claimed in claim 56, said fluid-propelling element being rotatably supported by a pair of bearing assemblies, said case presenting multiple pairs of opposed aligned mounting sockets, with the bearing assemblies being received in respective mounting sockets of one of the pairs.

62. The centrifugal supercharger as claimed in claim 56, said fluid-propelling element presenting an outer circumferential surface, said fluid-propelling element having an outer surface speed of at least about 3,500 feet per minute during rotation of the impeller.

63. The centrifugal supercharger as claimed in claim 54, said transmission including an impeller shaft that extends from the transmission chamber into the compression chamber to support the impeller, said transmission further including an input shaft that projects from the transmission chamber outside the case for connection to the power source.

64. The centrifugal supercharger as claimed in claim 63, each of said shafts being rotatably supported by a pair of bearing assemblies that are located within the transmission chamber.

65. The centrifugal supercharger as claimed in claim 63, said transmission including a drive gear fixed relative to the input shaft and a driven gear provided on the impeller shaft, said gears being located within the transmission chamber and drivingly connected so that power from the input shaft is transferred to the impeller shaft.

66. A compressor comprising:

a case presenting a compressor chamber and a transmission chamber, said transmission chamber having a fluid reservoir portion configured to hold a quantity of lubrication without filling the transmission chamber;

a rotatable impeller in the compressor chamber;

a transmission operable to drivingly connect the impeller to a power source such that the transmission serves to transfer driving power to the impeller, said transmission being located generally within in the transmission chamber but at least substantially outside the fluid reservoir portion thereof; and a lubricant pump located at least partly in the fluid reservoir portion of the transmission chamber, said lubricant pump being operable to transfer lubrication fluid in the fluid reservoir portion of the transmission chamber to the transmission, said lubricant pump being outside the driving connection between the impeller and power source so that at least substantially no driving power is transferred to the impeller by the lubricant pump.

67. The compressor as claimed in claim 66; and lubrication fluid contained entirely within the transmission chamber and filling only the fluid reservoir portion thereof.

68. The compressor as claimed in claim 66, said lubricant pump including a rotatable fluid-propelling element located at least partly in the fluid reservoir portion of the transmission chamber, with rotation of the fluid-propelling element causing lubrication fluid in the fluid reservoir portion to be transferred to the transmission.

69. The compressor as claimed in claim 68, said transmission including a generally cylindrical rotatable member, said fluid-propelling element presenting an outer, generally circular surface that engages the member so that rotation of the member effects rotation of the fluid-propelling element.

70. The compressor as claimed in claim 69, said transmission including a plurality of intermeshing gears, one of which is said rotatable member, said fluid-propelling element including circumferential teeth that intermesh with said one of the gears of the transmission so that rotation of the one gear effects rotation of the fluid-propelling element.

71. The compressor as claimed in claim 68, said fluid reservoir portion of the transmission chamber being positioned below the transmission.

72. The compressor as claimed in claim 71, said transmission chamber being generally teardrop-shaped in cross-section, with the fluid reservoir portion being wider in cross-section than any other portion of the transmission chamber.

73. The compressor as claimed in claim 68, said fluid-propelling element being rotatably supported by a pair of bearing assemblies, said case presenting multiple pairs of opposed aligned mounting sockets, with the bearing assemblies being received in respective mounting sockets of one of the pairs.

74. The compressor as claimed in claim 68, said fluid-propelling element presenting an outer circumferential surface, said fluid-propelling element having an outer surface speed of at least about 3,500 feet per minute during rotation of the impeller.

75. The compressor as claimed in claim 66, said transmission including an impeller shaft that extends from the transmission chamber into the compression chamber to support the impeller, said transmission further including an input shaft that projects from the transmission chamber outside the case for connection to the power source.

76. The compressor as claimed in claim 75, each of said shafts being rotatably supported by a pair of bearing assemblies that are located within the transmission chamber.

77. The compressor as claimed in claim 75, said transmission including a drive gear fixed relative to the input shaft and a driven gear provided on the impeller shaft, said gears being located within the transmission chamber and drivingly connected so that power from the input shaft is transferred to the impeller shaft.

78. A centrifugal supercharger comprising:

a case presenting a compressor chamber and a transmission chamber, said transmission chamber having a fluid reservoir portion configured to hold a quantity of lubrication without filling the transmission chamber;

a rotatable impeller in the compressor chamber;

a transmission operable to drivingly connect the impeller to a power source, with at least part of the transmission being located in the transmission chamber but outside the fluid reservoir portion thereof; and a rotatable fluid-transfer element located at least partly in the fluid reservoir portion of the transmission chamber, said fluid-transfer element being configured to rotate in such a manner as to cavitate and thereby produce a lubricant mist within the transmission chamber which serves to lubricate said at least part of the transmission.

79. The centrifugal supercharger as claimed in claim 78, said fluid-transfer element being outside the driving connections between the impeller and power source so that at least substantially no driving power is transferred to the impeller by the fluid-transfer element.

80. The centrifugal supercharger as claimed in claim 79; and lubrication fluid contained entirely within the transmission chamber and filling only the fluid reservoir portion thereof.

81. The centrifugal supercharger as claimed in claim 78; and lubrication fluid contained entirely within the transmission chamber and filling only the fluid reservoir portion thereof.

82. The centrifugal supercharger as claimed in claim 78, said transmission including a generally cylindrical rotatable member, said fluid-transfer element presenting an outer, generally circular surface that engages the member so that rotation of the member effects rotation of the fluid-transfer element.

83. The centrifugal supercharger as claimed in claim 82, said transmission including a plurality of intermeshing gears, one of which is said rotatable member, said fluid-transfer element including circumferential teeth that intermesh with said one of the gears of the transmission so that rotation of the one gear effects rotation of the fluid-transfer element.

84. The centrifugal supercharger as claimed in claim 78, said fluid reservoir portion of the transmission chamber being positioned below the transmission.

85. The centrifugal supercharger as claimed in claim 84, said transmission chamber being generally teardrop-shaped in cross-section, with the fluid reservoir portion being wider in cross-section than any other portion of the transmission chamber.

86. The centrifugal supercharger as claimed in claim 78, said fluid-transfer element being rotatably supported by a pair of bearing assemblies, said case presenting multiple pairs of opposed aligned mounting sockets, with the bearing assemblies being received in respective mounting sockets of one of the pairs.

87. The centrifugal supercharger as claimed in claim 78, said fluid-transfer element presenting an outer circumferential surface, said fluid-transfer element having an outer surface speed of at least about 3,500 feet per minute during rotation of the impeller.

88. The centrifugal supercharger as claimed in claim 78, said transmission including an impeller shaft that extends from the transmission chamber into the compression chamber to support the impeller, said transmission further including an input shaft that projects from the transmission chamber outside the case for connection to the power source.

89. The centrifugal supercharger as claimed in claim 88, each of said shafts being rotatably supported by a pair of bearing assemblies that are located within the transmission chamber.

90. The centrifugal supercharger as claimed in claim 88, said transmission including a drive gear fixed relative to the input shaft and a driven gear provided on the impeller shaft, said gears being located within the transmission chamber and drivingly connected so that power from the input shaft is transferred to the impeller shaft.

91. A compressor comprising:

a case presenting a compressor chamber and a transmission chamber, said transmission chamber having a fluid reservoir portion configured to hold a quantity of lubrication without filling the transmission chamber;

a rotatable impeller in the compressor chamber;

a transmission operable to drivingly connect the impeller to a power source, with at least part of the transmission being located in the transmission chamber but outside the fluid reservoir portion thereof; and a rotatable fluid-transfer element located at least partly in the fluid reservoir portion of the transmission chamber, said fluid-transfer element being configured to rotate in such a manner as to cavitate and thereby produce a lubricant mist within the transmission chamber which serves to lubricate said at least part of the transmission.

92. The compressor as claimed in claim 91, said fluid-transfer element being outside the driving connection between the impeller and power source so that at least substantially no driving power is transferred to the impeller by the fluid-transfer element.

93. The compressor as claimed in claim 92; and lubrication fluid contained entirely within the transmission chamber and filling only the fluid reservoir portion thereof.

94. The compressor as claimed in claim 91; and lubrication fluid contained entirely within the transmission chamber and filling only the fluid reservoir portion thereof.

95. The compressor as claimed in claim 91, said transmission including a generally cylindrical rotatable member, said fluid-transfer element presenting an outer, generally circular surface that engages the member so that rotation of the member effects rotation of the fluid-transfer element.

96. The compressor as claimed in claim 95, said transmission including a plurality of intermeshing gears, one of which is said rotatable member, said fluid-transfer element including circumferential teeth that intermesh with said one of the gears of the transmission so that rotation of the one gear effects rotation of the fluid-transfer element.

97. The compressor as claimed in claim 91, said fluid reservoir portion of the transmission chamber being positioned below the transmission.

98. The compressor as claimed in claim 97, said transmission chamber being generally teardrop-shaped in cross-section, with the fluid reservoir portion being wider in cross-section than any other portion of the transmission chamber.

99. The compressor as claimed in claim 91, said fluid-transfer element being rotatably supported by a pair of bearing assemblies, said case presenting multiple pairs of opposed aligned mounting sockets, with the bearing assemblies being received in respective mounting sockets of one of the pairs.

100. The compressor as claimed in claim 91, said fluid-transfer element presenting an outer circumferential surface, said fluid-transfer element having an outer surface speed of at least about 3,500 feet per minute during rotation of the impeller.

101. The compressor as claimed in claim 91, said transmission including an impeller shaft that extends from the transmission chamber into the compression chamber to support the impeller, said transmission further including an input shaft that projects from the transmission chamber outside the case for connection to the power source.

102. The compressor as claimed in claim 101, each of said shafts being rotatably supported by a pair of bearing assemblies that are located within the transmission chamber.

103. The compressor as claimed in claim 101, said transmission including a drive gear fixed relative to the input shaft and a driven gear provided on the impeller shaft, said gears being located within the transmission chamber and drivingly connected so that power from the input shaft is transferred to the impeller shaft.

104. A centrifugal supercharger comprising:

a case presenting a compressor chamber and a transmission chamber, said transmission chamber having a fluid reservoir portion configured to hold a quantity of lubrication without filling the transmission chamber;

a rotatable impeller in the compressor chamber;

a transmission operable to drivingly connect the impeller to a power source, with at least part of the transmission being located in the transmission chamber but outside the fluid reservoir portion thereof; and a rotatable fluid-transfer element located at least partly in the fluid reservoir portion of the transmission chamber, with rotation of the fluid-transfer element causing lubrication fluid in the fluid reservoir portion to be transferred to said at least part of the transmission, said fluid-transfer element presenting an outer circumferential surface, said fluid-transfer element having an outer surface speed of at least about 3,500 feet per minute during rotation of the impeller.

105. The centrifugal supercharger as claimed in claim 104, said fluid-transfer element being outside the driving connection between the impeller and power source so that at least substantially no driving power is transferred to the impeller by the fluid-transfer element.

106. The centrifugal supercharger as claimed in claim 105; and lubrication fluid contained entirely within the transmission chamber and filling only the fluid reservoir portion thereof.

107. The centrifugal supercharger as claimed in claim 104; and lubrication fluid contained entirely within the transmission chamber and filling only the fluid reservoir portion thereof.

108. The centrifugal supercharger as claimed in claim 104, said fluid-transfer element presenting an outer, generally circular surface.

109. The centrifugal supercharger as claimed in claim 108, said transmission including a generally cylindrical rotatable member, said outer surface of the fluid-transfer element engaging the member so that rotation of the member effects rotation of the fluid-transfer element.

110. The centrifugal supercharger as claimed in claim 109, said transmission including a plurality of intermeshing gears, one of which is said rotatable member, said fluid-transfer element including circumferential teeth that intermesh with said one of the gears of the transmission so that rotation of the one gear effects rotation of the fluid-transfer element.

111. The centrifugal supercharger as claimed in claim 104, said fluid reservoir portion of the transmission chamber being positioned below the transmission.

112. The centrifugal supercharger as claimed in claim 111, said transmission chamber being generally teardrop-shaped in cross-section, with the fluid reservoir portion being wider in cross-section than any other portion of the transmission chamber.

113. The centrifugal supercharger as claimed in claim 104, said fluid-transfer element being rotatably supported by a pair of bearing assemblies, said case presenting multiple pairs of opposed aligned mounting sockets, with the bearing assemblies being received in respective mounting sockets of one of the pairs.

114. The centrifugal supercharger as claimed in claim 104, said transmission including an impeller shaft that extends from the transmission chamber into the compression chamber to support the impeller, said transmission further including an input shaft that projects from the transmission chamber outside the case for connection to the power source.

115. The centrifugal supercharger as claimed in claim 114, each of said shafts being rotatably supported by a pair of bearing assemblies that are located within the transmission chamber.

116. The centrifugal supercharger as claimed in claim 114, said transmission including a drive gear fixed relative to the input shaft and a driven gear provided on the impeller shaft, said gears being located within the transmission chamber and drivingly connected so that power from the input shaft is transferred to the impeller shaft.

117. A compressor comprising:

a case presenting a compressor chamber and a transmission chamber, said transmission chamber having a fluid reservoir portion configured to hold a quantity of lubrication without filling the transmission chamber;

a rotatable impeller in the compressor chamber;

a transmission operable to drivingly connect the impeller to a power source, with at least part of the transmission being located in the transmission chamber but outside the fluid reservoir portion thereof; and a rotatable fluid-transfer element located at least partly in the fluid reservoir portion of the transmission chamber, with rotation of the fluid-transfer element causing lubrication fluid in the fluid reservoir portion to be transferred to said at least part of the transmission, said fluid-transfer element presenting an outer circumferential surface, said fluid-transfer element having an outer surface speed of at least about 3,500 feet per minute during rotation of the impeller.

118. The compressor as claimed in claim 117, said fluid-transfer element being outside the driving connection between the impeller and power source so that at least substantially no driving power is transferred to the impeller by the fluid-transfer element.

119. The compressor as claimed in claim 118; and lubrication fluid contained entirely within the transmission chamber and filling only the fluid reservoir portion thereof.

120. The compressor as claimed in claim 117; and lubrication fluid contained entirely within the transmission chamber and filling only the fluid reservoir portion thereof.

121. The compressor as claimed in claim 117, said fluid-transfer element presenting an outer, generally circular surface.

122. The compressor as claimed in claim 121, said transmission including a generally cylindrical rotatable member, said outer surface of the fluid-transfer element engaging the member so that rotation of the member effects rotation of the fluid-transfer element.

123. The compressor as claimed in claim 122, said transmission including a plurality of intermeshing gears, one of which is said rotatable member, said fluid-transfer element including circumferential teeth that intermesh with said one of the gears of the transmission so that rotation of the one gear effects rotation of the fluid-transfer element.

124. The compressor as claimed in claim 117, said fluid reservoir portion of the transmission chamber being positioned below the transmission.

125. The compressor as claimed in claim 124, said transmission chamber being generally teardrop-shaped in cross-section, with the fluid reservoir portion being wider in cross-section than any other portion of the transmission chamber.

126. The compressor as claimed in claim 117, said fluid-transfer element being rotatably supported by a pair of bearing assemblies, said case presenting multiple pairs of opposed aligned mounting sockets, with the bearing assemblies being received in respective mounting sockets of one of the pairs.

127. The compressor as claimed in claim 117, said transmission including an impeller shaft that extends from the transmission chamber into the compression chamber to support the impeller, said transmission further including an input shaft that projects from the transmission chamber outside the case for connection to the power source.

128. The compressor as claimed in claim 127, each of said shafts being rotatably supported by a pair of bearing assemblies that are located within the transmission chamber.

129. The compressor as claimed in claim 127, said transmission including a drive gear fixed relative to the input shaft and a driven gear provided on the impeller shaft, said gears being located within the transmission chamber and drivingly connected so that power from the input shaft is transferred to the impeller shaft.

130. In a powered vehicle including an engine, an improved centrifugal supercharger comprising:

a case presenting a compressor chamber defined between an outlet opening connected to the engine and an inlet opening, said case further presenting a transmission chamber having a fluid reservoir portion configured to hold a quantity of lubrication without filling the transmission chamber;

a rotatable impeller in the compressor chamber, with the impeller being operable to force air through the outlet opening when rotated;

a transmission operable to drivingly connect the impeller to the engine, with at least part of the transmission being located in the transmission chamber but outside the fluid reservoir portion thereof; and a rotatable fluid-transfer element located at least partly in the fluid reservoir portion of the transmission chamber, with rotation of the fluid-transfer element causing lubrication fluid in the fluid reservoir portion to be transferred to said at least part of the transmission, said fluid-transfer element presenting an outer circumferential surface, said fluid-transfer element having an outer surface speed of at least about 3,500 feet per minute during rotation of the impeller.

131. In the powered vehicle as claimed in claim 130, said fluid-transfer element being outside the driving connection between the impeller and engine so that at least substantially no driving power is transferred to the impeller by the fluid-transfer element.

132. In the powered vehicle as claimed in claim 131; and lubrication fluid contained entirely within the transmission chamber and filling only the fluid reservoir portion thereof.

133. In the powered vehicle as claimed in claim 130; and lubrication fluid contained entirely within the transmission chamber and filling only the fluid reservoir portion thereof.

134. In the powered vehicle as claimed in claim 130, said fluid-transfer element presenting an outer, generally circular surface.

135. In the powered vehicle as claimed in claim 134, said transmission including a generally cylindrical rotatable member, said outer surface of the fluid-transfer element engaging the member so that rotation of the member effects rotation of the fluid-transfer element.

136. In the powered vehicle as claimed in claim 135, said transmission including a plurality of intermeshing gears, one of which is said rotatable member, said fluid-transfer element including circumferential teeth that intermesh with said one of the gears of the transmission so that rotation of the one gear effects rotation of the fluid-transfer element.

137. In the powered vehicle as claimed in claim 130, said fluid reservoir portion of the transmission chamber being positioned below the transmission.

138. In the powered vehicle as claimed in claim 137, said transmission chamber being generally teardrop-shaped in cross-section, with the fluid reservoir portion being wider in cross-section than any other portion of the transmission chamber.

139. In the powered vehicle as claimed in claim 130, said fluid-transfer element being rotatably supported by a pair of bearing assemblies, said case presenting multiple pairs of opposed aligned mounting sockets, with the bearing assemblies being received in respective mounting sockets of one of the pairs.

140. In the powered vehicle as claimed in claim 130, said transmission including an impeller shaft that extends from the transmission chamber into the compression chamber to support the impeller, said transmission further including an input shaft that projects from the transmission chamber outside the case and is drivingly connected to the engine.

141. In the powered vehicle as claimed in claim 140, each of said shafts being rotatably supported by a pair of bearing assemblies that are located within the transmission chamber.

142. In the powered vehicle as claimed in claim 140, said transmission including a drive gear fixed relative to the input shaft and a driven gear provided on the impeller shaft, said gears being located within the transmission chamber and drivingly connected so that power from the input shaft is transferred to the impeller shaft.

143. In the powered vehicle as claimed in claim 130; and a drive mechanism drivingly connecting the transmission to the engine, said drive mechanism and said transmission being configured to rotate the fluid-propelling element at said outer surface speed during operation of the engine.

144. In the powered vehicle as claimed in claim 143, said drive mechanism comprising a belt drive including a plurality of sheaves and an endless belt drivingly connecting the sheaves.

* * * * *